US005932381A

United States Patent [19]

Akao et al.

[11] Patent Number: 5,932,381

[45] Date of Patent: Aug. 3, 1999

[54] ELECTROPHOTOGRAPHIC LITHOGRAPHIC PRINTING PLATE

[75] Inventors: Akio Akao; Kazumi Aoba; Hideyuki Yamamoto, all of Tokyo, Japan

[73] Assignee: Iwatsu Electric Company, Ltd., Japan

[21] Appl. No.: 09/165,413

[22] Filed: Oct. 2, 1998

[30] Foreign Application Priority Data

Oct. 3, 1997 [JP] Japan ..... 9-271668

[51] Int. Cl.[6] ..... G03G 5/14; G03G 5/087

[52] U.S. Cl. ..... 430/49; 430/63; 430/87

[58] Field of Search ..... 430/49, 63, 87

[56] References Cited

U.S. PATENT DOCUMENTS

| | | | |
|---|---|---|---|
| 3,639,121 | 2/1972 | York | 430/63 |
| 4,427,754 | 1/1984 | Uchida et al. | 430/96 |
| 4,520,089 | 5/1985 | Tazuki et al. | 430/49 |
| 5,212,030 | 5/1993 | Fogov | 430/49 |
| 5,219,687 | 6/1993 | Suzuki et al. | 430/49 |
| 5,460,912 | 10/1995 | Yamamoto et al. | 430/93 |

FOREIGN PATENT DOCUMENTS

| | | | |
|---|---|---|---|
| 488511 | 6/1992 | European Pat. Off. | 430/49 |
| 58-70240 | 4/1983 | Japan | 430/49 |
| 59-18956 | 1/1984 | Japan | 430/49 |
| 2-28143 | 6/1990 | Japan . | |
| 4-24700 | 4/1992 | Japan . | |
| 9-6059 | 1/1997 | Japan . | |

*Primary Examiner*—Roland Martin
*Attorney, Agent, or Firm*—Paul & Paul

[57] ABSTRACT

The present invention relates to an electrophotographic printing plate having high sensitivity to various light sources, high surface smoothness, high water resistance and excellent printability. An electrophotographic lithographic printing plate according to the present invention comprises:

a polyester film base having conductive layers on both surfaces thereof so that a surface resistance is from 0.1 to $10^7$ Ω/□, said both surfaces being electrically communicated at an end thereof; and a layer of an electrophotosensitive material, which contains zinc oxide as a photoconductive material and a binder resin and has surface smoothness of 500 to 3000 seconds, provided on one of the surfaces of said base.

10 Claims, 1 Drawing Sheet

ELECTROPHOTOGRAPHIC LITHOGRAPHIC PRINTING PLATE

BACKGROUND OF THE INVENTION

The present invention relates to a lithographic printing plate capable of making a plate by an electrophotographic system. More particularly, the present invention relates to a lithographic printing plate comprising a negative charge type photosensitive material having sensitivity to white light or a short wavelength light source such as semiconductor laser, LED array or the like, and a polyester base subjected to a treatment for imparting electrical conductivity.

As a high-sensitivity lithographic printing plate utilizing an electrophotographic system, a zinc oxide master paper obtained by coating a zinc oxide-resin dispersion photosensitive material on a paper base subjected to a process for imparting water and solvent resistance has hitherto been used. The master paper has recently been classified into two types for analogue plate making and digital plate making which, respectively, use different photosensitive materials, due to the different exposure systems for plate making. The analogue plate making is performed by a conventional camera exposure system, which is a system of exposing a zinc oxide photosensitive layer to reflected light, obtained by irradiating an original with light, through lens or mirror to form an electrostatic latent image. On the other hand, the digital plate making is a system of sending image data made by using a computer to a light source such as gas laser, semiconductor laser, LED array or the like, as a digital signal, and directly exposing a zinc oxide photosensitive material to a signal of light obtained from the light source to form an electrostatic latent image. In both systems, a lithographic printing plate is obtained by developing with a developer. Using these two types of master papers, a plate product is obtained through an electrophotographic process, however, it is necessary that a non-image area of a zinc oxide-resin dispersion other than a toner image of the plate product is subject to a hydrophilization treatment in order to be used as a lithographic printing plate. A hydrophilizing solution is, for example, an aqueous solution containing a ferrocyanide salt or phytic acid as a main component (so-called etching solution). Since zinc oxide and the above material forms a hydrophilic chelate compound on the surface, the surface physical properties such as hydrophilicity and hydrophobicity required for lithographic printing, are formed on the surface, thereby making it possible to perform printing. This process is referred to as a direct plate making and has advantages such as a reduced plate making time due to simplicity of the plate making step and low running cost.

However, in case of this master paper, an irregularity of the surface of fibers of the paper and coarse grains of zinc oxide could cause deterioration of the image quality in plate making and printing. At the time of offset printing, the paper is liable to be influenced by water and problems such as expansion, wrinkling and the like are liable to arise. On the other hand, an improvement in a paper base quality by means of an aluminum laminate, polyethylene laminate or the like and an improvement in the smoothness of the zinc oxide photosensitive material have been studied to solve the problems associated with the base and the zinc oxide photosensitive material. However, the resulting master papers have both merits and demerits and satisfactory master papers have not be obtained heretofore.

As a general lithographic printing plate, a PS plate (PRESENSITIZED PLATE) obtained by coating a positive photosensitive material of a diazo compound on an aluminum plate as a base which utilizes photodegradation and a PS plate obtained by coating a negative photosensitive material of an acrylic prepolymer etc., which utilizes photosetting are put into practical use. These plates are obtained by a system of making an original from a silver salt film, performing adhesion exposure using an ultraviolet lamp and subjecting the non-image area to an alkali eluation treatment to obtain a printing plate. Since the base is an aluminum plate, the smoothness of the surface, the mechanical strength and the water resistance are sufficient for offset printing. On the other hand, there is a problem in that the plate making step is complicated and a long plate making time is required, resulting in a very high cost. Recently, a digital exposure system for the PS plate has been suggested and a system capable of making a plate using an argon laser or a helium-neon laser has recently been put into practical use. However, the system was not satisfactory because of problems of stability with time, the cost of the plate material and the like.

There has also been suggested an OPC plate material wherein the base is an aluminum plate and the photosensitive material is an electrophotosensitive material. The sensitivity of this plate material is sufficiently fast but the cost of the plate material is high because the base is an aluminum plate.

An object of the present invention is to provide an electrophotographic printing plate, comprising a photosensitive material and a base, which has high sensitivity to various light sources such as a halogen lamp, an argon laser, a helium-neon laser, a semiconductor laser, a light emitting diode and the like, high surface smoothness, high water resistance and excellent printability.

SUMMARY OF THE INVENTION

The present inventors have developed an electrophotographic lithographic printing plate, characterized in that both surfaces of a polyester film base are subjected to a treatment to impart an electrical conductivity so that a surface resistance of each surface is from 0.1 to $10^7$ Ω/□, the both surfaces of the film base being electrically communicated at an end thereof and an electrophotosensitive material containing zinc oxide as a photoconductive material is applied to one of the surfaces of said film base, and, furthermore, a surface smoothness of said electrophotosensitive material is from 500 to 3000 seconds.

The electrophotographic lithographic printing plate of the present invention is an electrophotographic lithographic printing plate comprising:

- a polyester film base having conductive layers on both surfaces thereof so that a surface resistance is from 0.1 to $10^7$ Ω/□, said both surfaces being electrically communicated at an end thereof; and
- a layer of an electrophotosensitive material, which contains zinc oxide as a photoconductive material and a binder resin and has surface smoothness of 500 to 3000 seconds, is provided on one of the surfaces of said base.

DESCRIPTION OF THE PREFERRED EMBODIMENTS

Figure 1:
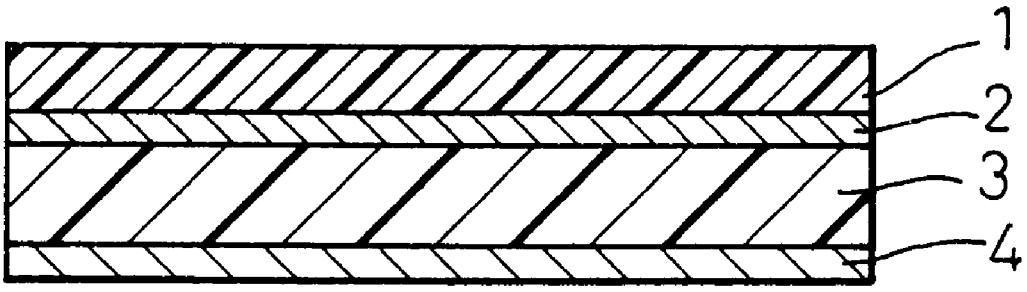
FIG. 1 is a sectional view showing one embodiment of an electrophotographic lithographic printing plate according to the present invention.

The binder resin of the elctrophotosensitive material is a blend of an acrylic resin having an acid value of 1.0 to 20.0 mgKOH/g and an acrylic resin having an acid value of 80 to 100 mgKOH/g and at least one acid component of which is 2-methacryloyloxyethyl monohexahydrophthalate.

The conducting treatment for the polyester film base of the printing plate of the present invention can be performed by forming a conductive layer on a polyester film. Regarding the conductive layer formed on both surfaces of the polyester film base, the surface resistance of the conductive layer on the side of the photosensitive material is adjusted within the range from $10^3$ to $10^7$ Ω/□ and the surface resistance of the conductive layer on the side opposite the photosensitive material is adjusted within the range from 0.1 to $10^3$ Ω/□.

In the printing plate of the present invention, a polyester film is used as the base to improve the surface smoothness, water resistance, mechanical strength and environmental stability of electrophotographic characteristics. The polyester film may be any one which satisfies the items defined in Japanese Industrial Standard (JIS). For example, there can be used Luminar S10, T60, H10, S56 and T56 (manufactured by Toray Co., Ltd.); E5000, E5100, E5001 and E5101 (manufactured by Toyobo Co., Ltd.); and S, V and SL (manufactured by Teijin Co., Ltd.).

As the above conductive intermediate layer, a conductive carbon coating composition, which makes it possible to impart the surface resistance of $10^3$ to $10^7$ Ω/□, can be used to form an image by an electrophotographic system. At this time, the coating weight of the conductive carbon is preferably from 3 to 10 g/m$^2$. When the surface resistance of the intermediate layer is too high or the intermediate layer is not present, the image is hardly formed, resulting in a state where the image density is too low. On the other hand, when the surface resistance of the intermediate layer is too low, pinhole-shaped white spots are formed on the image, resulting in defects. When the coating weight of the intermediate layer is not within the above range, an image having low image density or no image is formed.

It is important that the conductive carbon coating composition contains a conductive carbon as a principal agent and the binder resin has good adhesion to a polyester film and also has good adhesion to an electrophotosensitive layer. Therefore, the binder resin is composed of a polyester resin, an urethane resin, an urethane/acrylic resin or the like. A solvent for the binder is preferably a solvent having good solubility of the binder resin, and examples thereof include ketone solvents such as MEK, MIBK, etc., cellosolve solvents such as methylcellosolve, ethylcellosolve, etc. and acetate solvents such as ethyl acetate, butyl acetate, etc. The solvent may be appropriately mixed with toluene, xylene or the like.

Referring to FIG. 1, an electrophotographic lithographic printing plate is made as follows. One of the surfaces of a polyester film 3 is coated with a conductive intermediate layer 2 such as conductive carbon coating composition, and the other side of the polyester film 3 is coated with a conductive layer 4, for example, by vapor depositing aluminum. Both sides of the surfaces of the polyester film 3 at the end thereof are electrically communicated with each other by, for example, coating with the conductive carbon coating composition. An electrophotosensitive layer 1 is coated on the intermediate layer 2 with a wire bar etc. to form an electrophotographic lithographic printing plate.

The conductive layer provided on the side opposite the photosensitive layer on the polyester film base, that is, side opposite the conductive intermediate layer is preferably an aluminum deposit film. The aluminum deposit is normally formed by a general industrial technique applied to a polyester film, and the thickness of the deposit is preferably from 500 to 100 angstroms. This aluminum deposit film not only functions as a passage for corona current at the time of charging, but also imparts the electrode effect at the time of developing an electrostatic latent image in the developing area. Therefore, the aluminum deposit film is useful for improving the contrast of the image.

Regarding the printing plate of the present invention, it is necessary to perform an electrical communication treatment between the conductive intermediate layer, e.g. conductive carbon coating film provided on the polyester film as the base and the conductive layer, e.g. aluminum deposit film on the opposite side. The conductive coating composition used for the electrical communication treatment is preferably the above conductive coating composition, and the coating weight is preferably from 1 to 10 g/m$^2$. When the electrical communication treatment is not performed, there can be observed such phenomena as excess charges being non-uniformly accumulated in the process of charging by corona discharging because the polyester film has a good electrical insulating property. The excess corona current could be released by the electrical communication treatment, thereby making it possible to solve the defects at the time of charging.

A conventional electrophotosensitive material comprising zinc oxide has a smoothness of 100 to 400 seconds, and zinc oxide agglomerates having a grain size of about 50 μm are separately placed on the surface of the electrophotosensitive material. The printing plate of the present invention comprises a polyester film having high smoothness and an electrophotosensitive material wherein a maximum grain size of the zinc oxide agglomerate is not more than 25 μm, and the smoothness is from 500 to 3000 seconds, preferably from 800 to 1500 seconds. The smoothness is represented by the time (seconds) required to suck 10 ml of air under a constant suction pressure using a Beck smoothness testing machine (manufactured by Kumagaya Riki Kogyo Co., Ltd.). The longer the time, the higher the smoothness. The zinc oxide agglomerate having a grain diameter of about 50 μm is liable to exert an adverse influence on the uniformity of the toner image and the transfer of printing ink. On the other hand, the zinc oxide agglomerate particles are liable to be resistant to marking of the surface of the photosensitive material formed by rubbing and marking formed by pressure (hereinafter referred to as impressions). Therefore, it was difficult to remove the zinc oxide agglomerate particles having a particle diameter of about 50 μm and a zinc oxide-based electrophotographic printing plate having high smoothness could not be obtained. However, a print having high image quality is required. In case of printing using a higher grade paper, no problems arise even if the zinc oxide agglomerate having a particle diameter of about 50 μm is present. However, in case of a high-quality printing plate such as art paper, a satisfactory image quality cannot be obtained at present. It has been found that a problem associated with impressions is sufficiently solved by using a polyester film having high smoothness and conductivity instead of a conventional paper base. To obtain a photosensitive layer having high smoothness, a resin having high dispersibility to zinc oxide has been found and the object has been accomplished. The resin can be obtained by blending an acrylic resin having an acid value of 1.0 to 20.0 mgKOH/g with an acrylic resin having an acid value of 80 to 100 mgKOH/g where at least one acid component of which is 2-methacryloyloxyethyl monohexahydrophthalate.

The zinc oxide used in the photosensitive material constituting the printing plate of the present invention may be any one having photoconductivity, and those produced by the French method are generally used.

The binder resin used in the photosensitive material must be a binder resin which is capable of uniformly dispersing zinc oxide particles therein and is superior in electrophotographic characteristics, and which is capable of forming a photographic image having high quality. The binder resin is preferably composed of an acrylic resin having an acid value of 1.0 to 100.0 mgKOH/g at least one acid component of which is 2-methacryloyloxyethyl monohexahydrophthalate. Examples of the binder resin include methyl methacrylate/butyl methacrylate copolymer, ethyl methacrylate/butyl methacrylate copolymer, butyl methacrylate/styrene copolymer, or copolymer having a monomer unit capable of imparting a functional group to the above copolymer, such as acrylic acid, methacrylic acid, hydroxyethyl methacrylate, maleic acid, phthalic acid, itaconic acid, citraconic acid or the like, or those prepared by optionally blending copolymer resins.

For the purpose of imparting the sensitizing effect, dyes may be optionally added to the photosensitive material according to the wavelength of various light sources. In case of using a semiconductor laser as the light source, for example, cyanine dyes as disclosed in Examined Patent Publication (Kokoku) Nos. 4-24700 and 2-28143 are typically used and, furthermore, a cyanine dye represented by the following formula is used.

[Chemical Formula 1]

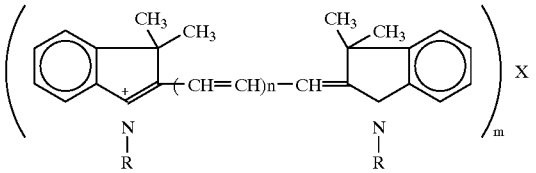

wherein n=2 or 3, X=acid anion such as $Cl^-$, $Br^-$ or $SO_3^{2-}$, and m=1 or 2.

In case of using a light source in a visible range, such as halogen lamp, xenon lamp, argon laser, helium-neon laser, LED lamp or the like, for example, there can be used diphenylmethane, triphenylmethane, xanthene, phthalein type dyes, and rose bengal, and rose bengal is most typical.

When the above binder resin is used, the zinc oxide and binder resin show high dispersibility, but the photosensitive material coating composition of the printing plate of the present invention can be dispersed by a wet dispersion mixer. Examples of the dispersion mixer include a ball mill, a sand mill and the like, and any of them can be used. However, it has already been found that, when the photosensitive material coating composition is dispersed by applying a strong mechanical shear, the sensitivity thereof falls and the effect of a lipo-insensitization treatment, (hydrophilization treatment) at the time of printing is lowered. Therefore, it is important to sufficiently disperse the photosensitive material coating composition in the production of the photosensitive material coating composition of the present invention so that electrical characteristics in electrophotography are good and the lipo-insensitization treatment at the time of printing is good.

The coating weight of the photosensitive material of the printing plate of the present invention is set within the range from 10 to 30 g/m$^2$. When the coating weight is not within this range, low or excess image density occurs, resulting in narrow latitude of image reproduction.

The printing plate of the present invention can be easily sensitized by a hydrophilizing solution containing a ferrocyanide salt or phytic acid as a main component, similar to a conventional zinc oxide type electrophotographic printing plate. The non-image area other than the toner image is hydrophilized by this hydrophilizing treatment, thereby making it possible to perform offset printing. The above hydrophilizing solution is an aqueous solution comprising a ferrocyanide salt or phytic acid as a principal agent, a phosphate, a water-soluble polymer and saccharides, and the pH thereof is adjusted to within the range from 3 to 6.

EXAMPLES

The examples of the present invention will be described below, but the present invention is not limited thereto.

Example 1

Production of Conductive Base of Printing Plate

On one surface of a polyester film sheet E5000 manufactured by Toyobo Co., Ltd., opposite the surface on which an aluminum was deposited to a thickness of 500 angstroms, an urethane-based conductive carbon coating composition was coated in a coating weight of 1.0 g/m$^2$. At this time, the surface resistance was $1\times10^5$ Ω/□. The same conductive carbon coating composition was coated on the end of this sheet to obtain a conductive polyester film base.

Photosensitive Material Coating Composition and Production of Electrophotographic Printing Plate

| | |
|---|---|
| Zinc oxide | 100 parts by weight |
| Methyl methacrylate/butyl methacrylate copolymer (acid value: 2.5) | 10 parts by weight |
| Methyl methacrylate/butyl methacrylate/acrylic acid three-component copolymer (acid value: 12.0) | 10 parts by weight |
| Methyl methacrylate/n-butyl methacrylate/2-methacryloyloxyethyl monohexahydrophthalate (acid value: 96.0) | 2.5 parts by weight |
| Cyanine dye (0.2% by weight of methanol solution) | 5 parts by weight |
| Toluene | 127.5 parts by weight |

A mixed solution of the above formulation was dispersed in a ball mill for 3.5 hours to prepare a photosensitive material coating composition. Then, this photosensitive material coating composition was coated on the above conductive base at a coating rute of 20 g/m$^2$ using a wire bar, and dried in a drier at 100° C. for 1 minute. The obtained printing plate after the completion of drying was allowed to stand in a dark place at a temperature of 20° C. under a humidity of 60% for 48 hours to obtain an electrophotographic lithographic printing plate. At this time, the smoothness of the photosensitive surface was 1100 seconds. A printing plate product was made by introducing a wet developer VP-3 set (manufactured by Iwasaki Tsushinki Co., Ltd.) into Elefax Plate Setter LP-501CR (1200DPI, manufactured by Iwasaki Tsushinki Co., Ltd., digital plate making machine using a 780 nm semiconductor laser light source), thereby obtaining a high-contrast image free from photographic fog. Then, this plate product was etched by using an etching solution V (manufactured by Iwasaki Tsushinki Co., Ltd.) as a hydrophilizing solution and printing was performed by using an offset printing press. At this time, the printed image quality was very good and uniform application of ink was observed on an art paper (coated paper). That is, good printed image quality with wide latitude was obtained. The image quality was good even after printing 10,000 copies.

Example 2

A conductive base of a printing plate was produced in the same manner as that described in Example 1 except for changing the sensitizing dye of the photosensitive material coating composition from the cyanine dye to rose bengal. An electrophotographic printing plate was obtained. At this time, the smoothness of the photosensitive surface was 1000 seconds. A plate product was made by introducing a wet developer VP-3 set into an Elefax Plate Setter IP-551R (1200DPI manufactured by Iwasaki Tsushinki Co., Ltd., digital plate making machine using halogen lamp), thereby obtaining a high-contrast image free from photographic fog. Then, this plate product was etched by using an etching solution V (manufactured by Iwasaki Tsushinki Co., Ltd.) as a hydrophilizing solution and printing was performed by using an offset printing press. At this time, the printed image quality was very good and uniform application of ink was observed on an art paper (coated paper). That is, a good printed image quality with wide latitude was obtained. The image quality was good even after printing 10,000 copies.

Comparative Example 1

An elecrophotographic printing plate was obtained by the same operation as that described above except that the surface resistance was $5\times10^8$ Ω/□ when the urethane-based conductive carbon coating composition was coated in the coating weight of 10 g/m$^2$ in the conductive base of the printing plate. A plate product was further made and printing was tried to be performed in the same manner as that described in Example 1, but the whole image was fogged, thereby making it impossible to perform printing.

Comparative Example 2

By the same operation as that described above except that the end of the base is not subjected to an electrical communication treatment using a conductive carbon coating composition in the conductive base of the printing plate, an electrophotographic printing plate was obtained. A plate product was further made and printing was tried to be performed in the same manner as that described in Example 1, but the whole image was fogged, thereby making it impossible to perform printing.

Comparative Example 3

By the same operation as that described in Example 1 except that the photosensitive material is prepared according to the following formulation, an electrophotographic lithographic printing plate was obtained.

Formulation of Photosensitive Material

| | |
|---|---|
| Zinc oxide | 100 parts by weight |
| Methyl methacrylate/butyl methacrylate copolymer (acid value: 2.5) | 10 parts by weight |
| Methyl methacrylate/butyl methacrylate/acrylic acid three-component copolymer (acid value: 12.0) | 10 parts by weight |
| Cyanine dye (0.2% by weight of methanol solution) | 5 parts by weight |
| Toluene | 125 parts by weight |

A mixed solution of the above formulation was dispersed in the same manner as that described in Example 1 to prepare a photosensitive solution. Then, this photosensitive solution was coated on the same conductive base as that of Example 1. As a result, the smoothness of the photosensitive surface was 300 seconds. Plate making and printing were performed in the same manner as described in Example 1. As a result, the application of ink on an art paper (coated paper) was not uniform and the image quality was not satisfactory.

Comparative Example 4

By the same operation as that described in Example 1 except for using a base comprising an intermediate layer and an undercoat layer, obtained by coating a thermosetting latex wherein sericite and kaolin are dispersed, on a water-resistant paper having a basis weight of 120 g/cm$^2$, an electrophotographic printing plate with a paper base was obtained. At this time, the smoothness of the photosensitive surface was 400 seconds. Plate making and printing were performed in the same manner as described in Example 1. As a result, severe staining was caused by impression and, furthermore, application of ink on an art paper (coated paper) was not uniform and the image quality was not satisfactory. At this time, the printing capacity was 3,000 copies.

The results of a quantitative test with respect to the samples produced in the above examples and comparatives are shown below.

Test Conditions

Measuring instrument: EPA8100 manufactured by Kawaguchi Denki Seisakusho Co., Ltd.

Charging: −6.5 kV STAT 1

Light intensity:

single wavelength of 780 nm: 5 μW/cm$^2$ tungsten lamp: 3 lux

V5: surface potential 5 seconds after the completion of charging

E1/2: light amount required to reduce the surface potential V5 to a half

Vr: surface potential 15 seconds after the completion of light irradiation

DD%: potential attenuation factor of surface potential V5 to surface potential V60 after being allowed to stand in a dark place for 60 seconds (1-V60/V5)×100

TABLE 1

Test results

| | Surface potential V5 (v) | Sensitivity E1/2 (erg/cm$^2$) | Residual potential Vr (V) | Dark attenuation factor DD % (%) | Measured wave-length λ (nm) |
|---|---|---|---|---|---|
| Example 1 | −405 | 30 | −1 | 20 | 780 |
| Example 2 | −411 | 15 (LUX · SEC) | −2 | 18 | White light |
| Comp. Example 1 | * | * | * | * | * |
| Comp. Example 2 | * | * | * | * | * |
| Comp. Example 3 | −408 | 32 | −1 | 19 | 780 |
| Comp. Example 4 | −510 | 28 | −2 | 22 | 780 |

*impossible to measure

As described above, the electrophotographic lithographic printing plate of the present invention has high sensitivity to various light sources such as a halogen lamp, a semiconductor laser and the like, and the surface smoothness of the surface of the photosensitive material is from 500 to 3000 seconds. As a result, contrast of the photographic image was high and the applicability of printing ink was remarkably improved, thereby making it possible to obtain a high-image quality print having high plate wear resistance and wide latitude.

We claim:

1. An electrophotographic lithographic printing plate comprising:

a polyester film base having conductive layers on both surfaces thereof so that a surface resistance is from 0.1 to $10^7$ Ω/□, said both surfaces being electrically communicated at an end thereof; and a layer of an electrophotosensitive material, which contains zinc oxide as a photoconductive material and a binder resin and has surface smoothness of 500 to 3000 seconds, provided on one of the surfaces of said base.

2. The electrophotographic lithographic printing plate according to claim 1, wherein the layer of the electrophotosensitive material has surface smoothness of 800 to 1500 seconds.

3. The electrophotographic lithographic printing plate according to claim 1 or 2, wherein the binder resin of the electrophotosensitive material is a blend of an acrylic resin having an acid value of 1.0 to 20.0 mgKOH/g and an acrylic resin having an acid value of 80 to 100 mgKOH/g at least one acid component of which is 2-methacryloyloxyethyl monohexahydrophthalate.

4. The electrophotographic lithographic printing plate according to any one of claims 1 to 2, wherein the surface resistance of the conductive layer on the side of the photosensitive material is adjusted within the range from $10^3$ to $10^7$ Ω/□ and the surface resistance of the conductive layer on the side opposite the photosensitive material is adjusted within the range from 0.1 to $10^3$ Ω/□ on the polyester film base.

5. The electrophotographic lithographic printing plate according to any one of claims 1 to 2, wherein the conductive layer on the side of the photosensitive material is a conductive carbon coating film.

6. The electrophotographic lithographic printing plate according to claim 5, wherein the conductive carbon coating film has coating weight of 3 to 10 g/$m^2$.

7. The electrophotographic lithographic printing plate according to any one of claims 1 to 2, wherein the conductive layer on the side opposite the photosensitive material is an aluminum deposit film.

8. The electrophotographic lithographic printing plate according to claim 7, wherein the aluminum deposit film has thickness of 500 to 1,000 angstroms.

9. The electrophotographic lithographic printing plate according to any one of claims 1 to 2, wherein both surfaces of the polyester film are electrically communicated by means of a conductive carbon coating composition.

10. The electrophotographic lithographic printing plate according to any one of claims 1 to 2, wherein the layer of the electrophotosensitive material further contains dyes to sensitize the electrophotosensitive material.

* * * * *